United States Patent [19]

Arcilesi

[11] 4,119,502

[45] Oct. 10, 1978

[54] ACID ZINC ELECTROPLATING PROCESS AND COMPOSITION

[75] Inventor: Donald A. Arcilesi, Mount Clemens, Mich.

[73] Assignee: M&T Chemicals Inc., Stamford, Conn.

[21] Appl. No.: 825,402

[22] Filed: Aug. 17, 1977

[51] Int. Cl.[2] ..... C25D 3/22

[52] U.S. Cl. ..... 204/55 R

[58] Field of Search ..... 204/55 R, 55 Y, 43 Z

[56] References Cited

U.S. PATENT DOCUMENTS

| | | | |
|---|---|---|---|
| 2,674,619 | 4/1954 | Lundsted | 106/308 Q X |
| 3,594,291 | 7/1971 | Todt et al. | 204/55 R |
| 3,694,330 | 9/1972 | Korpiun et al. | 204/55 R |
| 3,729,394 | 4/1973 | Hsu et al. | 204/55 R |
| 3,730,855 | 5/1973 | Poor et al. | 204/55 R |
| 3,778,359 | 12/1973 | Popescu | 204/55 R |
| 3,855,085 | 12/1974 | Rushmere | 204/55 R |
| 3,878,069 | 4/1975 | Todt | 204/55 R |
| 3,891,520 | 6/1975 | Todt et al. | 204/55 R |
| 3,928,149 | 12/1975 | Steeg | 204/55 R |
| 3,972,788 | 8/1976 | Passal | 204/55 R |
| 4,014,761 | 3/1977 | Passal | 204/55 R |
| 4,070,256 | 1/1978 | Hsu et al. | 204/55 R |

FOREIGN PATENT DOCUMENTS

| | | | |
|---|---|---|---|
| 602,591 | 5/1948 | United Kingdom | 204/DIG. 2 |

*Primary Examiner*—G. L. Kaplan

*Attorney, Agent, or Firm*—Kenneth G. Wheeless; Robert Spector

[57] ABSTRACT

This invention relates to a method of producing lustrous to brilliant zinc electrodeposits, which comprises passing current from a zinc anode to a metal cathode for a time period sufficient to deposit a lustrous to brilliant zinc electrodeposit upon said cathode; the current passing through an aqueous acidic bath composition containing at least one zinc compound providing zinc cations for electroplating zinc, said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives at least one alkyl propoxyethoxy polyether, at least one aromatic sulfonate emulsifying agent, and at least one aromatic carbonyl compound.

6 Claims, No Drawings

ACID ZINC ELECTROPLATING PROCESS AND COMPOSITION

BRIEF DESCRIPTION

This invention relates to the electrodeposition of bright zinc from an acidic electrolyte. More particularly this invention relates to improved zinc plating bath compositions, to methods of using and preparing such bath compositions and to improved surfaces having bright zinc electrodeposits thereon.

BACKGROUND OF THE INVENTION

The enactment and enforcement of various environmental protection laws, especially those designed to improve water quality, have made it desirable to significantly reduce or eliminate the discharge of cyanides, phosphates, and a number of metal ions, from the effluents of electroplating plants. As a result, non-polluting bright zinc plating processes have been sought as alternatives to the classical zinc cyanide baths.

Alkaline solutions containing complex compounds of zinc and alkaline metal pyrophosphates have been proposed as a replacement for cyanide baths and cyanide processes for the electrodeposition of bright zinc. The electrodeposition of zinc using a pyrophosphate bath, however, may give relatively poor low current density coverage. Spore formation, roughness, insufficient brightness, and relatively non-uniform deposits. In addition, passivation of the anodes may produce undesirable precipitates which in turn can clog filter systems and sometimes results in intermittent operation necessitated by frequent changes of filter media.

The use of phosphates may also produce waste disposal problems since phosphates are not easily removed and may promote the growth of undesirable aquatic plant life if discharged into streams. These disposal disadvantages further limit the acceptance of pyrophosphate zinc plating bath compositions in industrial applications.

Non-cyanide zincate zinc plating baths have also been proposed as substitutes for cyanide containing systems. However, the bright plating current density range of these baths is quite limited, making the plating of articles of complex shape difficult, if not impossible. Since the addition of cyanide to these non-cyanide zincate baths greatly improves the bright plate current density range of the deposits, platers tend to add cyanides to their zincate systems, thus negating the non-cyanide feature of the original bath.

Highly acidic zinc plating baths have been known for some time and such baths are cyanide-free. These systems do not produce bright decorative deposits, (in the currently accepted usage of the word "bright"), have extremely poor low current density coverage and find their chief application in the strip line plating of wire and sheet steel using very high but narrow current density ranges. Thus, they are not suited for plating objects of complex shape or for normal decorative, or rustproofing application.

Neutral, mildly alkaline or mildly acidic non-cyanide zinc plating baths containing large amounts of buffering and complexing agents to stabilize pH and solubilize the zinc ions at the pH values involved have been employed to overcome the objections of using cyanide-based zinc plating processes.

In order to improve and increase the brightness, luster and throwing power of zinc deposits from these baths, certain organic aromatic carbonyl compounds are generally used as brighteners.

These brighteners provide fairly satisfactory zinc deposits, but the deposits tend to be dull in the low current density regions, and they have a limited solubility in mildly acidic zinc electrolytes.

DETAILED DESCRIPTION

This invention relates to a method of producing bright zinc electrodeposits over a wide current density range, which comprises passing current from a zinc anode to a metal cathode for a time period sufficient to deposit a bright zinc electrodeposit upon said cathode; the current passing through an aqueous acidic bath composition containing at least one zinc compound providing zinc cations for electroplating zinc, said zinc compound selected from the group consisting of zinc sulfate, zinc choride and zinc sulfamate; chloride anions added as salts of bath compatible cations, in the absence of complexing or chelating agents of organic nature; and containing as cooperating additives at least one alkyl propoxyethoxy polyether, at least one aromatic sulfonate dispersing or emulsifying agent, and, at least one aromatic carbonyl compound. The alkyl propoxyethoxy polyether carrier brighteners of this invention provide such a high degree of luster and ductility when used with auxiliary brighteners and primary brighteners, that ammonium salts are completely unnecessary.

The zinc deposits of this invention are lustrous to brilliant, smooth, relatively ductile, low in internal stress, have low tarnishing tendencies and good receptivity to conversion coatings.

Carrier brighteners of the general type:

$$C_nH_{2n+1}-(OC_3H_6)_{m_1}-(OC_2H_4)_{m_2}-OH$$

where $n = 6$ to 14, $m_1 = 1$ to 6, $m_2 = 10$ to 20 exemplified by propoxylated ethoxylated lauryl alcohol (MW1020), having the following structure:

$$CH_3-(CH_2)_{11}-(OCH(CH_3)-CH_2)_3-(OCH_2CH_2)_{15}-OH$$

give superior results when used in combination with auxiliary brighteners such as the condensation products of naphthalene sulfonic acid and formalin e.g.

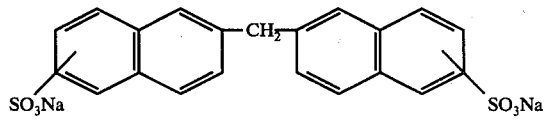

or alkyl aromatic ether sulfonates such as sodium n-decyl diphenyl ether disulfonate:

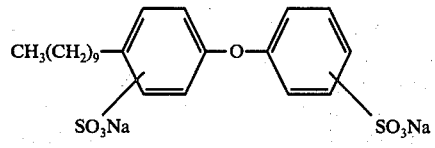

and aromatic carbonyl primary brighteners of the general type $$RCH{=}CHC{-}R_1 \\ \| \\ O$$

where $R_1$ is an alkyl radical of 1 to 3 carbons and R is an aromatic or heteroaromatic radical which may be unsubstituted or carry substituents such as —OH, —$OCH_3$, —$OC_2H_5$, —$OC_3H_7$, —$OCH_2O$—, —$OC_2H_5OH$, —COOH, —$NO_2$, —$NH_2$, —$N(C_nH_{2n+1})_2$ where $n$ is 1 to 6, —$N(CH_2CH_2OH)_2$, etc.

The superiority of this process can be illustrated by comparing the examples of this invention to those obtained with carrier brighteners of prior art.

The carrier brighteners of this invention also function as solubilizing agents for brightening agents, such as benzal acetone, that would normally be difficult to dissolve in the electrolyte of subsequent Example #1. Also, permitting the use of high concentrations of these additives in the electrolyte without deleterious effects.

EXAMPLES

The acid zinc examples of this invention were prepared as follows:

Acid Zinc Electrolyte

First a mixing vessel was filled half-way to the desired final volume with distilled water.

Then a zinc compound, such as zinc chloride, was mixed into the water so as to function as a source of metal ions for subsequent electrodeposition.

Next an alkali metal salt, such as potassium chloride, was added to the above mixture to provide high electrical conductivity to the electrolyte during subsequent electrodeposition.

To the above mixture a buffering agent, such as boric acid, was then added so that the pH of the final electrolyte could ultimately be easily maintained between approximately 5 and 6. The pH should be maintained between approximately 5 and 6 because as the pH of the electrolyte drops below about 5, the zinc anodes begin to dissolve excessively, and at a pH of about 6 zinc hydroxide forms and precipitates out of the electrolyte. It should be noted that as the bath is electrolyzed the pH will slowly rise. It can be lowered by adding concentrated hydrochloric acid. If it is necessary to raise the pH, it can be raised by adding a solution of sodium hydroxide.

After the zinc compound, the conducting salt and the buffering agent are mixed together, the mixture is raised to its final volume, and after all of the constituents are dissolved, the mixture is filtered. This filtered mixture is an acid zinc electrolyte without grain refining additives.

Acid Zinc Grain Refining Agents

To the acid zinc electrolyte, grain refining additives are added in the following order:

First, the carrier brighteners are added to the electrolyte which is mixed until they are dissolved. The carrier brighteners of this invention not only produce primary grain refining, but also help to solubilize subsequent primary brighteners which would normally have a low solubility in an acid zinc electrolyte.

Next, the auxiliary brighteners, which produce secondary grain refining and also help to solubilize subsequent primary brighteners, are added to the electrolyte which is mixed until they are dissolved.

Finally, the primary brighteners, which produce tertiary grain refining — i.e., these compounds can synergistically produce a very high degree of brightness — in combination with the other components of the system, are added to the electrolyte which is mixed until they are dissolved.

PLATING

The examples of this invention were evaluated in 267 ml. Hull Cells and in 4 liter rectangular plating cells as follows:

HULL CELL TESTS

Hull Cell tests were run under conditions described as follows:

A polished steel or brass panel was scribed with a horizontal single pass of 4/0 grit emery to give a band width of about 1 cm. at a distance of about 2.5 cm. from the bottom of the panel. After suitably cleaning the panel, it was plated in a 267 m. Hull Cell, at a 2 ampere cell current for 5 minutes, at a temperature of 20° C. using magnetic stirring and a 99.99+pure zinc sheet as an anode.

4 LITER PLATING CELL

The 4 liter plating cell tests were run under the following conditions:

Plating cell — 5 liter rectangular cross-section (13 cm. × 15 cm.) made of Pyrex.

Solution volume — 4 liters to give a solution depth, in absence of anode, of about 20.5 cm.

Temperature — 20° F. (maintained by immersing cell in a thermostatically controlled water bath).

Agitation — bubbling air.

Anode — 99.99+zinc balls, 5 cm. in diameter strung on titanium wire — 5 balls per cell.

Cathode — brass strip (2.54 cm. × 20.3 cm. × 0.071 cm.) buffed and polished on one side and immersed to a depth of about 17.8 cm. — horizontal bend 2.54 cm. from bottom and the next 2.54 cm. bent to give an internal angle on the polished side of cathode of about 45° — polished side facing anode at an approximate distance of 10.2 cm. and scribed vertically in center with a 1 cm. wide band of a single pass of 4/0 grit emery paper scratches.

Cell current — 2.0 to 5.0 amperes.

Time — 5 minutes to 8 hours per day.

Some deposits were plated for 5 to 15 minutes to give normally utilized thicknesses of zinc (0.2 to 0.5 mils or 5.1 to 12.7 microns) while other deposits were plated for as long as 7 to 8 hours to observe physical properties such as ductility, tensile stress, etc. and to provide sufficient electrolysis to deplete some of the organic additives.

GENERAL OPERATING CONDITIONS

Cathode current densities may range from about 0.1 to 5.0 amperes per square decimeter (ASD) depending on whether the plating is done in barrels or on racks and on such factors as concentration of bath zinc metal, conducting salts, buffers, etc., and on the degree of cathode agitation. Anode current densities also may range from about 0.5 to 3.0 ASD depending on bath ingredient concentrations, degree of solution circulation around the anodes, etc.

The operating temperature of the baths are ambient temperatures ranging from about 15° to 40° C. Agitation is of the moving cathode rod type or involving the use of air.

Anodes generally consist of 99.99+pure zinc which may be immersed in the plating bath in baskets made of an inert metal such as titanium or which may be suspended in the bath by hooks hanging on the anode bar made of an inert metal such as titanium.

The plating baths may be used for rack or barrel plating purposes. The basis metals generally plated are ferrous metals such as steel or cast iron to be zinc plated for protection against rusting by a cathodic protection mechanism and also for providing decorative eye appeal. To further enhance the protective action of the zinc, the zinc after plating may be subjected to a conversion coating treatment, generally by immersion or anodic electrolytic action in baths containing hexavalent chromium, catalysts, accelerators, etc. The conversion coating treatment may enhance the luster of the zinc as plated by a chemical or electropolishing action as well as providing a conversion coating film consisting of a mixture of Cr VI, CR III and Zn compounds ranging in color from very light iridescent, to blue, to iridescent yellow to olive drab etc. The more highly colored coatings are thicker and may provide better corrosion protection in humid saline atmospheres. To further enhance protective action, usually on the more transparent, lighter colored films, there may be applied lacquer coatings, air dried or baked. To some of the thinner, lighter-colored conversion coating there may be applied a more intense and varied color by immersion in solutions of suitable dyestuffs to give pure jet black to pastel range of colors which may then be followed by lacquer coatings to apply protection against abrasion, finger staining etc., in use.

During the plating operation, it is desirable to keep metallic contaminants at very low concentration levels in order to insure a bright zinc electrodeposit. Such contamination from metal ions, (such as cadmium, copper, iron, and lead) may be reduced or eliminated through conventional purification methods. Other types of contaminants (such as organic contaminants) may also be eliminated or reduced by circulation of the zinc electroplating solution through a suitable filter media such as activated carbon or types of ion exchange or absorption media.

The following examples are submitted to further the understanding of the operation of the invention and should not be construed so as to limit its scope.

EXAMPLE I

An acid zinc bath was prepared having the following composition:

| | |
|---|---|
| $ZnCl_2$ | 100 g/l |
| KCl | 200 g/l |
| $H_3BO_3$ | 20 g/l |
| $CH_3-(CH_2)_{10}-(OCH(CH_3)-CH_2)_3-(OCH_2CH_2)_{15}-OH$ | 10 g/l |
| 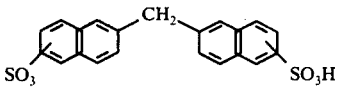 | 10 g/l |
| 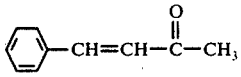 | 0.5 g/l |
| pH: Adjusted to 5.5 | |

Bent cathodes or Hull Cell panels electroplated in the solution of example #1 are bright and ductile over current densities ranging from about 0 to 20 ASD.

EXAMPLE II

The same as example #1 but instead of the auxiliary brightener of example #1, 10 g/l of the following auxiliary brightener was used:

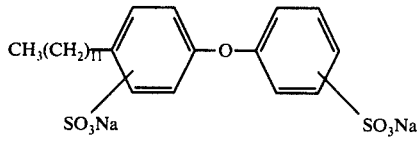

Bent cathodes or Hull Cell panels electroplated in the solution of example #2 are bright and ductile over current densities ranging from about 0 to 20 ASD.

EXAMPLE III

Same as example #1 except that 5 g/l of the auxiliary brightener of example #1, in addition to 5 g/l of the auxiliary brightener of example #2 was used.

Bent cathodes or Hull Cell panels electroplated in the solution of example #3 are unusually bright and uniform, as well as ductile, over current densities ranging from about 0 to 20 ASD.

What is claimed is:

1. A method for producing lustrous to brilliant zinc electrodeposits which comprises passing current from a zinc anode to a metal cathode for a time period sufficient to deposit a lustrous to brilliant zinc electrodeposit upon said cathode, the current passing through an aqueous acidic bath compositing containing at least one zinc compound providing zinc cations for electroplating zinc, said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives at least one alkyl propoxyethoxy polyether exhibiting the formula:

$$C_nH_{2n+1}-(OC_3H_6)_{m_1}-(OC_2H_4)_{m_2}-OH$$

where $n$ is an integer of from 6 to 14, $m_1$ is an integer of from 1 to 6, and $m_2$ is an integer of from 10 to 20, at least one aromatic sulfonate emulsifying agent, and at least one aromatic carbonyl compound.

2. The process of claim 1 wherein at least one zinc compound is selected from zinc sulfate, zinc chloride and mixtures thereof.

3. The process of claim 1 wherein said zinc compound is zinc sulfamate.

4. An aqueous acidic plating solution containing at least one zinc compound providing zinc cations for electroplating zinc, said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives at least one alkyl propoxyethoxy polyether exhibiting the formula:

$$C_nH_{2n+1}-(OC_3H_6)_{m1}-(OC_2H_4)_{m2}-OH$$

where $n$ is an integer of from 6 to 14, $m_1$ is an integer of from 1 to 6, and $m_2$ is an integer of from 10 to 20, at least one aromatic sulfonate emulsifying agent, and at least one aromatic carbonyl compound.

5. The composition of claim 4 wherein at least one zinc compound is selected from zinc sulfate, zinc chloride and mixtures thereof.

6. The composition of claim 4 wherein said zinc compound is zinc sulfamate.

* * * * *